US005224579A

United States Patent [19]

Brown

[11] Patent Number: 5,224,579

[45] Date of Patent: Jul. 6, 1993

[54] VAULT SECURITY AND IDENTIFICATION SYSTEM

[75] Inventor: Terry Brown, Capalaba, Australia

[73] Assignee: TST International Pty. Ltd., Acacia Ridge, Australia

[21] Appl. No.: 815,950

[22] Filed: Dec. 30, 1991

[30] Foreign Application Priority Data

Jun. 28, 1991 [AU] Australia ..... PK6922

[51] Int. Cl.[5] ..... G07F 9/06

[52] U.S. Cl. ..... 194/350; 232/16

[58] Field of Search ..... 194/350, 202; 232/12, 232/13, 16, 43.2; 109/45, 47

[56] References Cited

U.S. PATENT DOCUMENTS

| | | | |
|---|---|---|---|
| 3,966,116 | 6/1976 | Dominick et al. | 232/16 X |
| 4,134,539 | 1/1979 | Hopkinson | 235/482 X |
| 4,177,889 | 12/1979 | Adams et al. | 194/350 |
| 4,380,316 | 4/1983 | Glinka et al. | 232/16 |
| 4,471,905 | 9/1984 | Sloma et al. | 232/15 X |
| 4,955,532 | 9/1990 | Kanehasa et al. | 232/16 X |

FOREIGN PATENT DOCUMENTS

| | | | |
|---|---|---|---|
| 1925458 | 12/1970 | Fed. Rep. of Germany | 194/350 |
| 54-108698 | 8/1979 | Japan | 194/350 |
| 2230371 | 10/1990 | Japan | 194/350 |

*Primary Examiner*—Michael S. Huppert
*Assistant Examiner*—William M. Hienz
*Attorney, Agent, or Firm*—Buchanan Ingersoll; George Raynovich, Jr.

[57] ABSTRACT

An automatic coin machine including a coin acceptor and identifier and a removable vault. The vault is adapted to receive coins from the coin acceptor and identifier and is adapted to be removed to permit counting of the coins. The machine includes a vault housing for receiving a corresponding vault, a code definer associated with the vault and a code sensor. The code sensor is adapted to detect the code of the code definer to provide a vault security identification system.

7 Claims, 4 Drawing Sheets

VAULT SECURITY AND IDENTIFICATION SYSTEM

This invention relates to an improved security and identification system which has particular, although not exclusive applicability to automatic coin machines of the type used in toll systems for roads or the like.

Automatic coin machines used at toll collection stations along a toll road generally include a coin acceptor and identifying mechanism which receives coins and causes the opening of a boom gate to allow the passage of a vehicle when the correct coins have been received. Normally such machines include removable vaults which are adapted to receive coins from the coin acceptor mechanism of the machine and which may then be removed to permit counting of the coins. It is important in such vaults to have an identification system so that correct correlation can be made between the coins deposited into the coin machine and subsequently those directed to a specified vault. In the past vault identification has been achieved by the use of mechanical connections which will only permit certain vaults to be installed into the machine. Such connections, however, have not proved particularly reliable so that correct vault placement is not always guaranteed. It is further important that the coin vaults have means which prevent access thereto when removed from the machine other than by authorized personnel.

The present invention aims to overcome or alleviate one or more of the above disadvantages by providing an improved security and identification system for vaults in automatic coin machines which ensures correct identification of a vault in a reliable and efficient manner. The system of the invention may also be used in other applications for the purposes of identification. The present invention also aims to provide a system for securing a vault prior to removal from an automatic coin machine. Other objects and advantages of the invention will become apparent from the following description.

With the above and other objects in view the present invention provides in one preferred aspect a security and identification system for a member adapted to be brought into register within a further member, said system including code defining means and code sensing means carried by the respective said members, said sensing means being adapted to detect the code of said code defining means.

Preferably the code defining means comprise one or more magnetic field defining devices such as permanent magnets arranged in an array and said code sensing means is adapted to sense the presence or absence of a magnetic field. Preferably said code sensing means comprise one or more Hall effect semiconductors which can detect the presence of a magnetic field.

In one particular preferred aspect the system is suitably applied to removable vaults associated with automatic coin machines with said sensing means carried by the machine and said code defining means supported on said vault. Preferably said vault is supported for sliding movement in and out of said machine and said code defining means is mounted on a rear wall of the vault so as to be alignable with the code sensing means carried by the machine. Preferably guide means are provided to guide said code defining means into alignment with said code sensing means.

The present invention in a further aspect provides a vault assembly including a vault having an opening for receipt of coins or the like and an outer housing for receipt of said vault, said vault opening including hatch means for closing said opening and co-operable means associated with said vault and said vault housing and adapted to close said hatch and thereby said opening upon withdrawal of said vault from said vault housing.

Suitably said hatch includes an actuating member movable to open and close said hatch and said vault housing includes camming means adapted to co-operate with said actuating member so as to cause closure of said hatch upon withdrawal of said vault from said vault housing.

The vault assembly preferably also includes releasable locking means for releasably locking said vault within said vault housing.

Reference will now be made to the accompanying drawings which illustrate a preferred embodiment of the invention and wherein.

Figure 8:
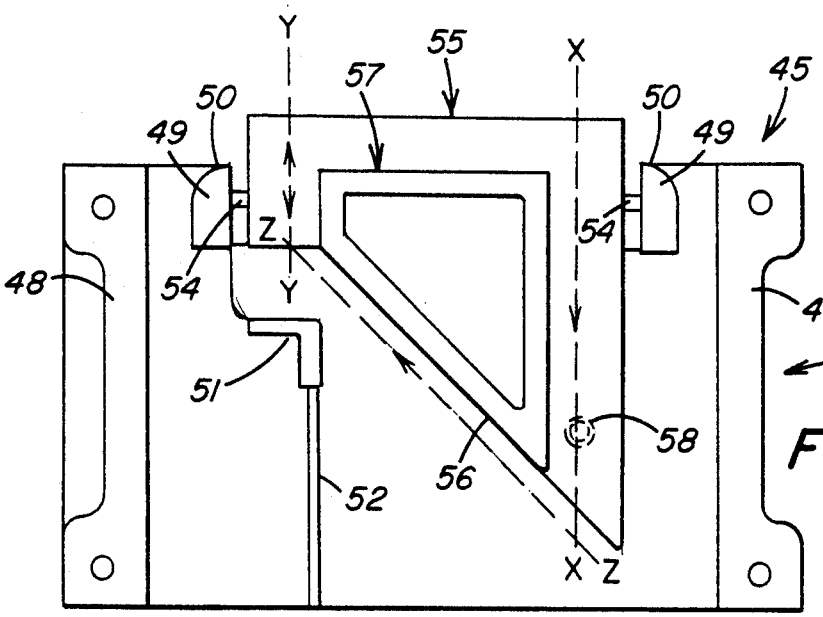
FIGS. 8 and 9 illustrates opposite sides of the camming block assembly of the vault housing.
Figure 8A:
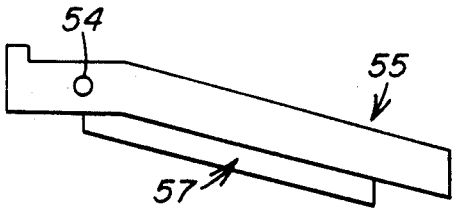
Figure 9:
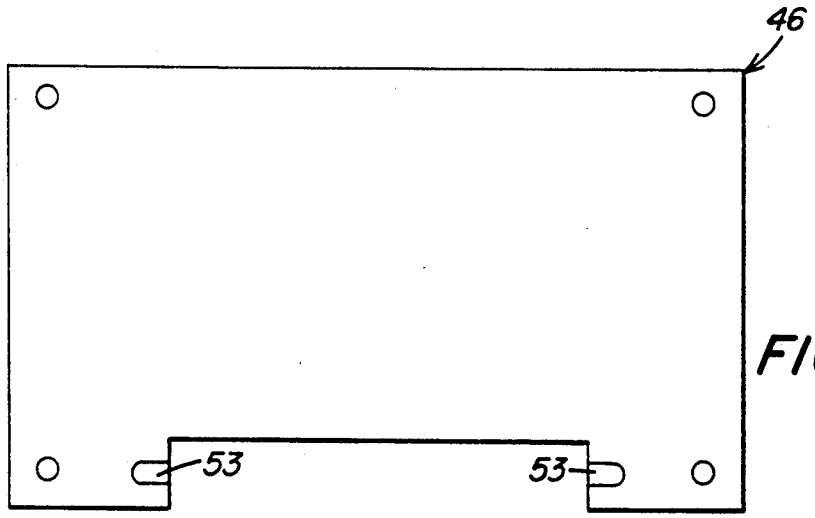
Figure 9A:
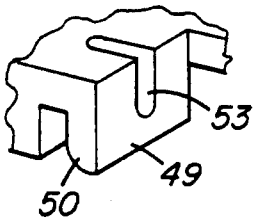
Figure 10:
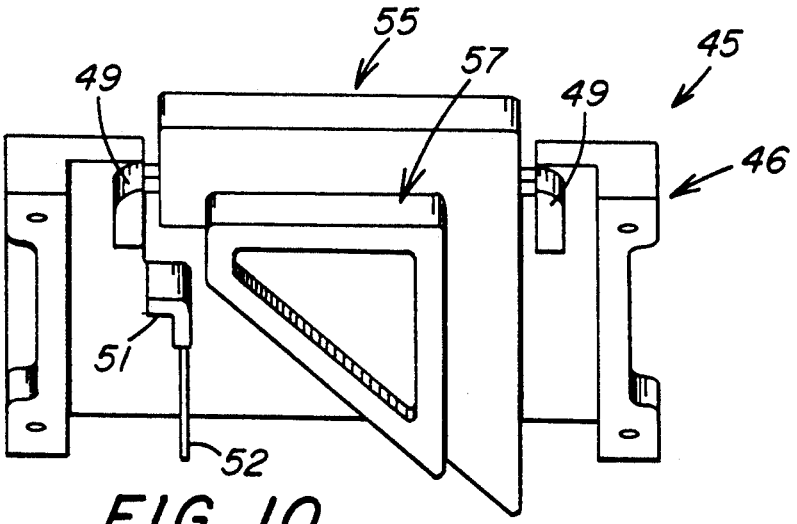
Figure 11:
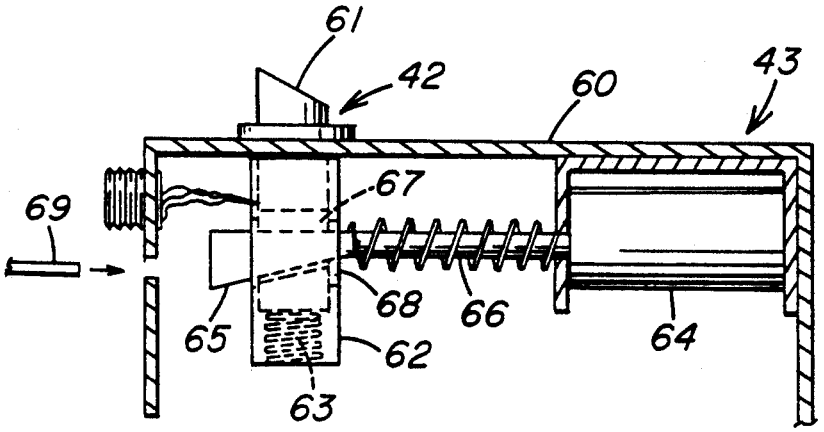

FIG. 8*a* is a side elevational view of the camming block;

FIG. 9*a* illustrates a view in the direction A of FIG. 9 showing details of the pivot slot;

FIG. 10 is a perspective view of the camming lock assembly;

FIG. 11 is a sectional view of the vault lock assembly; and

Figure 12:
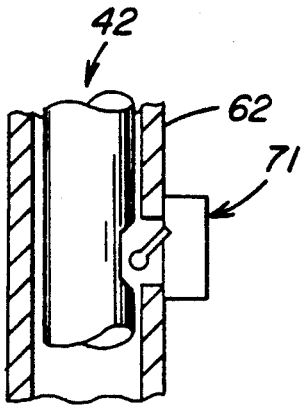

FIG. 12 illustrates details of the vault lock assembly pin.

Figure 1:
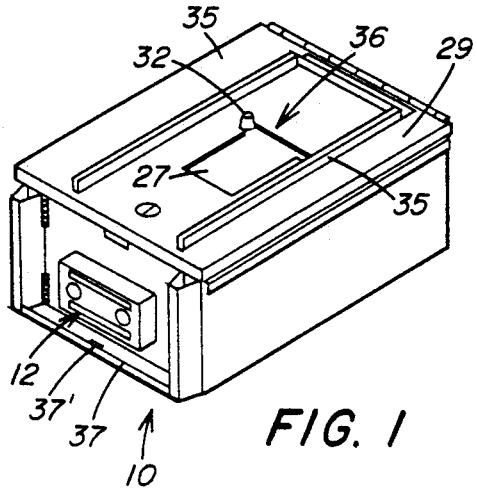
FIGS. 1 and 2 illustrate a vault according to the present invention.
Figure 2:
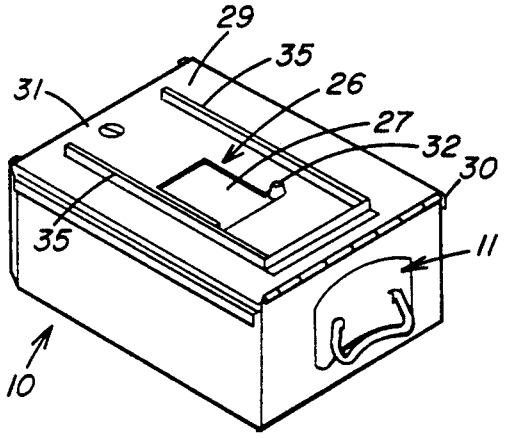

Referring to the drawings and firstly to FIGS. 1 and 2 there is illustrated a vault 10 according to the invention for collecting coins, notes etc. deposited into an automatic coin machine. The vault 10 is of rectangular hollow form being suitably constructed of stainless steel and including at one end a handle 11 and at its opposite end an encoding block 12 the purpose of which will hereafter become apparent. The vault 10 is arranged to be slid in use in drawer-like fashion into a hollow housing 13 (see FIGS. 5 and 6) so that the encoding block 12 becomes aligned with a sensing head 14 arranged at the rear of the housing 13.

Figure 3:
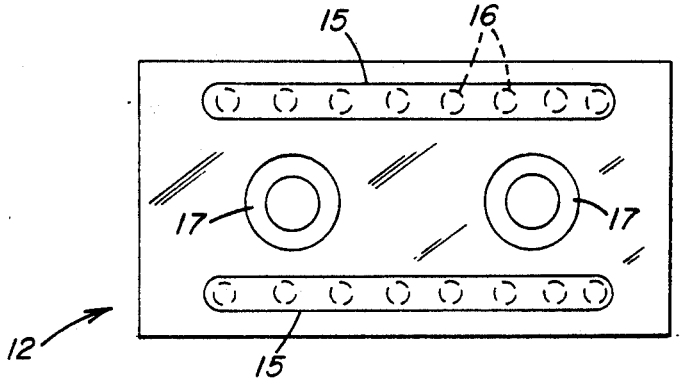
FIG. 3 illustrates in end elevational view the encoding block for fitting to the vault.
Figure 4:
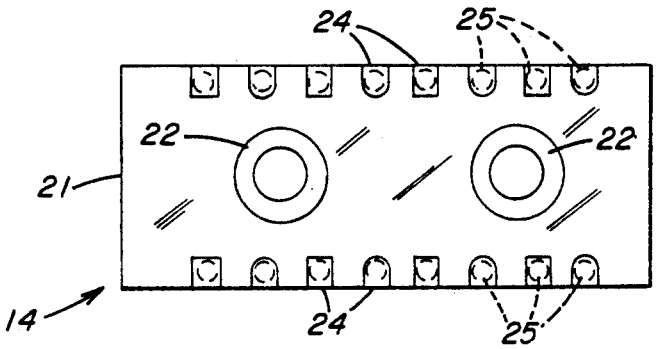
FIG. 4 illustrates in end elevational view the sensing head for sensing the code of the encoding block.

As more clearly shown in FIG. 3 the encoding block 12 is formed of non-magnetic material and provided with a pair of spaced apart elongated slots 15 in which a series of magnets 16 shown in dotted outline may be located and held therein by any suitable material such as a resin. The magnets 16 may be arranged in any desired pattern so that, for example the presence of a magnet at a certain position indicates the binary 1, whilst the absence of a magnet in that position indicates a binary 0. Preferably the arrangement is such that a sixteen bit pattern is formed with up to eight magnets in each slot 15. Thus if one slot 15 is provided with eight magnets the binary number 11111111 is formed. The absence of a magnet in a certain position, for example the second position in the top slot 15 will produce the binary number 10111111. Thus any desired pattern of magnets can form an identifying sixteen bit number providing identification of that vault 10.

The encoding block 12 also incorporates a pair of alignment bushes 17, preferably formed of brass or other non magnetic material which are adapted to be aligned with alignment pins 18 (see FIG. 6) in the housing 13.

Figure 6:
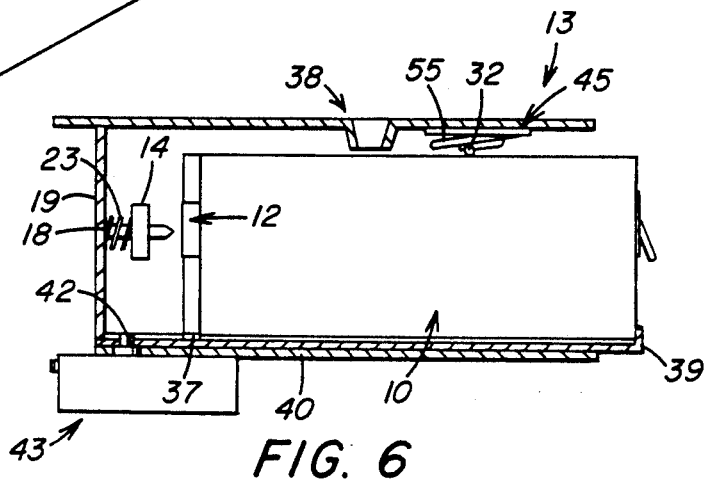
FIG. 6 is a sectional view showing the vault inserted into its associated vault housing.
Figure 7:
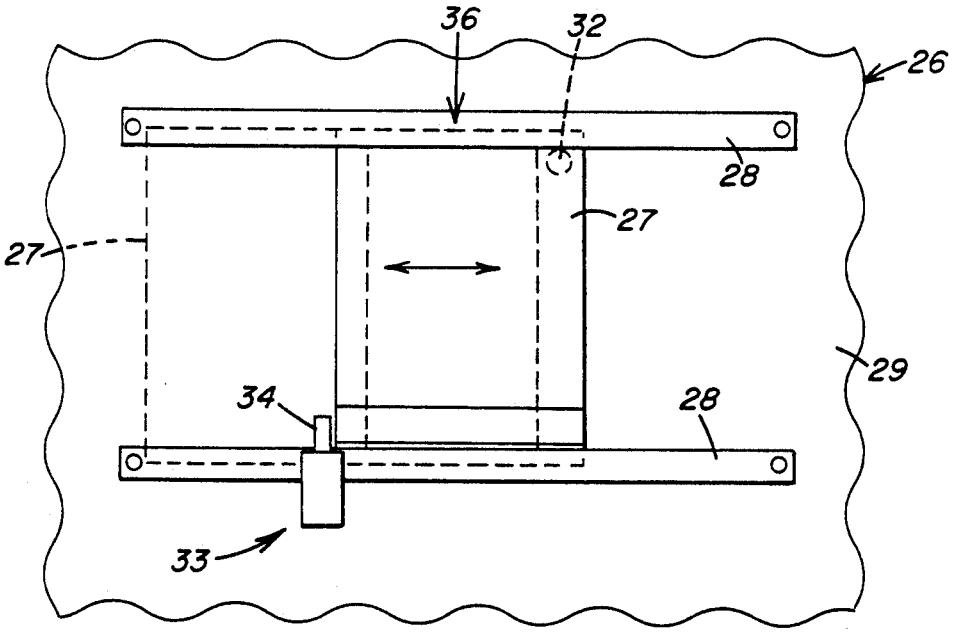
FIG. 7 is an underside view of vault lid and closing hatch of the vault.

As shown in FIG. 6 the alignment pins 18 are fixed to the end wall 19 of the housing 13 to extend outwardly therefrom, being spaced apart substantially the same distance as the distance between the bushes 17. The pins 18 support for sliding movement thereon the sensing head 14 which includes a block 21 provided with bushes 22 for sliding engagement with the pins 18, the bushes 22 also being formed of brass or other non magnetic material. Respective springs 23 are provided about the pins 18, between the block 21 and end wall 19 of the housing 13 so as to normally bias the block 21 outwardly from the end wall 19. The block 21 is provided with a plurality of cut-outs 24 in its longitudinal edges spaced apart the same distance as the distance between the magnet positions in the encoding block 12. Located in the cut-outs 24 are respective magnet sensitive switches which preferably comprise Hall effect integrated circuits 25 which will provide an output when adjacent a magnet 16. The Hall effect circuits 25 are connected through an interface to a validation circuit for comparison with a preset code.

In use the vault 10 is inserted into the housing 13 so that the bushes 17 locate over the pins 18, the latter serving to correctly align the encoding block 12 with the sensing head 14. During movement of the vault 10 into the housing 13 the springs 23 cushion the engagement between the encoding block 12 and sensing head 14. Should the array of magnets 16 in the encoding block 12, as sensed by the respective Hall effect integrated circuits 25 correspond to the preset code the automatic coin machine will be caused to direct coins to the vault 10. If the code is not valid, indicating that the vault 10 in the incorrect vault, no coins will be diverted into the vault 10.

The vault 10 also incorporates a top hatch assembly 26 which is opened for insertion of the vault 10 into the housing 13 but which automatically closes when the vault 10 is removed. The hatch assembly 26 includes a sliding hatch member 27 supported for sliding movement along opposite guides or rails 28 which are provided on the underside of a top lid 29 of the vault 10, the lid 29 being hingedly connected at 30 to the remainder of the vault 10 and being able to be locked in a closed position by means of a key actuated lock 31. A hatch actuating pin 32 projects upwardly from the hatch member 27 and a spring loaded locking pin assembly 33 including a spring loaded locking pin 34 is mounted to the underside of the lid 29 of the vault 10 so as to prevent the hatch member 27 from opening after it has been closed. The lid 29 also includes a pair of longitudinally extending guides 35 which are spaced apart on opposite sides of the hatch member 27, the purpose of which will hereinafter become apparent. The latch member 27 is adapted to open and close an opening 36 in the lid 29 as described below. Additionally the rear of the vault 10 as shown in FIG. 1 is provided with an extended base flange 37 which includes a centrally located lock aperture 37' which functions in a manner described below.

Figure 5:
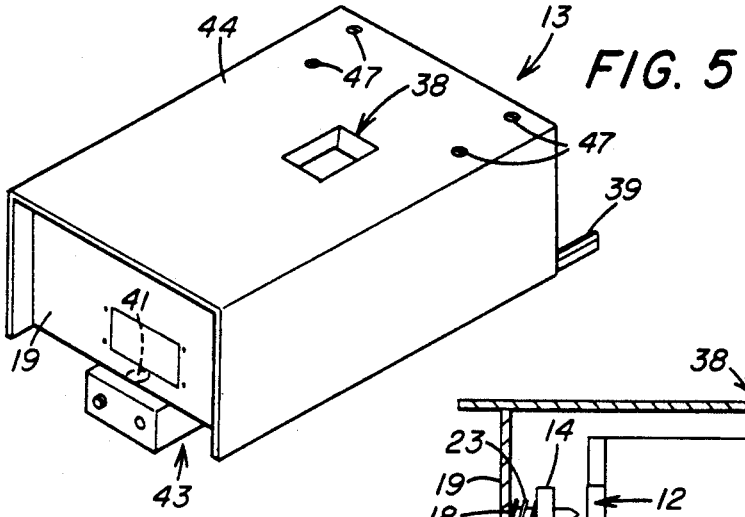
FIG. 5 illustrates in rear view a vault housing for receiving a vault according to the invention.

The vault housing 13 as shown in FIGS. 5 and 6 is of generally rectangular form including a top opening 38 for receipt of coins from say a deposit guide chute and a pair of spaced apart angled sectioned rails 39 along which the vault 10 is guided into the housing 13. The base wall 40 of the housing 13 adjacent the rear wall 19 thereof is provided with an opening 41 through which a locking pin 42 of a lock assembly 43 may project.

Mounted to the underside of the top wall 44 of the housing 13 is a camming block assembly 45 which is adapted to close the hatch member 27 upon withdrawal of the vault 10. The camming block assembly 45 as more clearly illustrated in FIGS. 8, 9 and 10 includes a fixed base member 46 which is mounted to the underside of the top wall 44 by screw fasteners 47, screwed into a pair of side flanges 48 of the base member 46. The base member 46 also includes a pair of posts 49 spaced from their adjacent flanges 48 a distance such as to receive the guide members 35 of the vault 10 upon insertion of the latter into the housing 13. The posts 49 are curved at 50 at their leading ends so as to provide for any misalignment between the vault 10 and housing 13. The base member 46 also includes rearwardly of, and inwardly of one post 49, on a stop member 51 of angle sectioned form and an elongated guide 52 extends from the stop member 51 to the trailing side of the base member 46.

The posts 49 are provided with slots 53 (see FIGS. 9 and 9*a*) to pivotally receive opposite spigots 54 of a camming block 55, the block 55 including a trailing camming surface 56 which extends at an angle across the base member 46 as illustrated. The camming block 55 as also shown in FIG. 8*a* also includes a raised triangular guide or stop portion 57, the purpose of which will become apparent below. A coil spring 58 is interposed between the block 55 and base 46 to apply a bias to the camming block 55 to pivot it away from the base member 46 about the pivot spigots 54 to an extent allowed by abutment of the camming block 55 with the base member 46 so that the block 55 is inclined downwardly as shown in FIG. 6.

In use and for insertion of the vault 10 into the housing 13, the vault lid 29 is opened by releasing the lock 31, and the spring loaded pin 34 is depressed so as to allow the hatch member 27 to be opened, the hatch member 27 maintaining the pin 34 retracted. The vault 10 is then aligned with the housing 13 and slid into the housing 13 along the tracks 39 with the guides 35 passing between the posts 49 and flanges 48 on opposite sides of the base member 46. The actuating pin 32 for the hatch during insertion of the vault 10 into the housing 13 will move along the path X—X shown in FIG. 8 engaging and causing the camming block 55 to pivot upwardly against the bias of the spring 58 and gravitational forces until the pin 32 moves beyond the camming block 55 which will thence pivot back to its normal inclined position. Should the vault 10 be inserted into the housing 13 with the hatch 27 half opened the pin 32 will strike the leading surface of the stop 57, thus preventing insertion of the vault 10. If the hatch 27 vault is fully closed when the vault 10 is attempted to be inserted into the housing 13 the pin 32 will move along the path Y—Y shown in FIG. 8 to strike the stop 51 and again prevent the vault 10 from being moved into the housing 13.

If the vault 10 is to be withdrawn from the housing 13 the trailing camming surface 56 will be engaged by the pin 32 of the hatch member 27 and cause the pin 32 to move in the direction Z—Z along the camming surface 56 so as to cause the hatch member 27 to close the opening 36. When the hatch member 27 is fully closed, the pin 32 will be free of the camming surface 56 being moved to a position where withdrawal of the vault 10 will move the pin 32 along the path Y—Y so that the vault 10 is free for movement out of the housing 13. When the hatch member 27 is moved to a closed position, the spring loaded pin 34 will again be urged to the extended position of FIG. 8 to prevent opening of the hatch member 27 unless the lid 29 is unlocked. Thus the contents of the vault 10 will be securely held within the vault 10.

The vault assembly 10 may also include the lock assembly 43 which is mounted to the underside of the housing 13 and which includes a casing 60 carrying the reciprocal locking member or pin 42 which may project through the opening 41 in the base wall 40 into the corresponding opening in the vault 10, the locking member 42 including a ramped top surface 61. The locking pin 42 is mounted for reciprocating movement within a tubular guide 62 being normally biased outwardly by a spring 63. A solenoid 64 having a camming member 65 coupled to its actuating shaft 66 which is biased outwardly by a spring is actuable to cause withdrawal of the locking pin 42 to permit the vault 10 to be withdrawn from the housing 13. The solenoid 64 for this purpose may be controlled remotely and the camming member 65 preferably projects through a slot 67 in the pin 42 and slot 68 in the guide 62. The locking pin 42 may also be retracted by manually moving the camming member 65 by movement of a suitable tool 69 into an opening 70 to engage the camming member 65 to cause retraction of the pin 62. Movement of the locking pin 62 may also be sensed by a limit switch 71 so that unauthorized tampering may be readily sensed (see FIG. 12).

The camming block assembly 45 may be of many different forms, for example the components of the base member 46 may be fabricated in a number of pieces whilst the biasing of the camming block 55 may be by means of any suitable spring arrangement. Alternatively in some instances spring biasing of the camming block 55 may be eliminated.

Whilst the present invention is particularly applicable to the vaults of automatic coin machines, it may be readily be applied to other situations where closing of a hatch or other member is required. It will also be apparent that the vault identification arrangement may include encoding blocks and sensing blocks of any suitable form. For example the encoding block 12 may be of disc-like form with slots arranged arcuately for receiving magnets 16 and a corresponding pattern of magnets sensing means provided in a sensing block.

Whilst the above has been given by way of illustrative embodiment of the invention, all such modifications and variations thereto as would be apparent to persons skilled in the art are deemed to fall within the broad scope and ambit of the invention as herein set forth.

I claim:

1. An automatic coin machine including coin acceptor and identifying means and removable vault means, said vault means adapted to receive coins from said coin acceptor and identifying means and adapted to be removed to permit counting of the coins, said machine including vault housing means for receiving said vault means, supporting means for allowing sliding movement of said vault means in and out of said vault housing means, code defining means, said code defining means comprising code defining block means supported on said vault means, code sensing means, said code sensing means comprising code sensing block means supported on said vault housing means, said code defining means comprising magnetic field defining devices arranged in an array of said code defining block means, said code sensing means comprising Hall effect circuits on said code sensing block means which detect the presence of a magnetic field, said machine adapted so that said code defining block means approaches said code sensing block means frontally as said vault means moves drawer-like into said vault housing means, a validation circuit for comparison of code from said magnetic field defining devices with a preset code, said Hall effect circuits connected to said validation circuit, said machine adapted so that if the code is not validated no coins will be diverted to said vault means.

2. The automatic coin machine of claim 1 including aligning means on said code sensing block means for aligning said magnetic field defining devices with said Hall effect circuits.

3. The automatic coin machine of claim 1 wherein said code sensing block means is spring mounted to bias said Hall effect circuits against said magnetic field defining devices and for cushioning the engagement between said magnetic field defining devices and said Hall effect circuits.

4. The automatic coin machine of claim 3 including locking means for locking said vault means in place when said magnetic field defining devices are in operative engagement with said Hall effect circuits.

5. The automatic coin machine of claim 1 wherein said code defining block means contains elongated slots containing an array of magnets.

6. The automatic coin machine of claim 1 wherein said code sensing block means comprises longitudinal edge cut-outs containing said Hall effect circuits.

7. An automatic coin machine including coin acceptor and identifying means and removable vault means, said vault means adapted to receive coins from said coin acceptor and identifying means and adapted to be removed to permit counting of the coins, said machine including vault housing means for receiving said vault means, supporting means for allowing sliding movement of said vault means in and out of said vault housing means, code defining means, said code defining means comprising code defining block means supported on said vault means, code sensing means, said code sensing means comprising code sensing block means supported on said vault housing means, said code defining means comprising magnetic field defining devices arranged in an array on said code defining block means, said code sensing means comprising Hall effect circuits on said code sensing block means which detect the presence of a magnetic field, said machine adapted so that said code defining block means approaches said code sensing block means frontally as said vault means moves drawer-like into said vault housing means, aligning means on said code sensing block means for aligning said magnetic field defining devices with said Hall effect circuits, said code sensing block means being spring mounted to bias said Hall effect circuits against said magnetic field defining devices and for cushioning the engagement between said magnetic field defining devices and said Hall effect circuits, locking means for locking said vault means in place when said magnetic field defining devices are in operative engagement with said Hall effect circuits, said code defining block means containing elongated slots containing an array of magnets, said code sensing block means comprising longitudinal edge cut-outs containing said Hall effect circuits, a validation circuit for comparison of code from said magnetic field defining devices with a preset code, said Hall effect circuits connected to said validation circuit, said machine adapted so that if the code is not validated no coins will be diverted to said vault means.

* * * * *

UNITED STATES PATENT AND TRADEMARK OFFICE

CERTIFICATE OF CORRECTION

PATENT NO. : 5,224,579

DATED : July 6, 1993

INVENTOR(S) : TERRY BROWN

It is certified that error appears in the above-identified patent and that said Letters Patent is hereby corrected as shown below:

Title page, item [56] References Cited, Foreign Patent Documents, Patent No. 2230371, change "Japan" to --United Kingdom--.

Signed and Sealed this

Twelfth Day of April, 1994

Bruce Lehman

*Attest:*

BRUCE LEHMAN

*Commissioner of Patents and Trademarks*

*Attesting Officer*